US010135140B2

(12) United States Patent
Yosui et al.

(10) Patent No.: US 10,135,140 B2
(45) Date of Patent: Nov. 20, 2018

(54) ANTENNA

(71) Applicant: MURATA MANUFACTURING CO., LTD., Kyoto-fu (JP)

(72) Inventors: Kuniaki Yosui, Ishikawa-ken (JP); Hiroyuki Kubo, Ishikawa-ken (JP); Hiromitsu Ito, Ishikawa-ken (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 446 days.

(21) Appl. No.: 13/765,541

(22) Filed: Feb. 12, 2013

(65) Prior Publication Data

US 2014/0071011 A1 Mar. 13, 2014

Related U.S. Application Data

(63) Continuation of application No. 12/894,954, filed on Sep. 30, 2010, now Pat. No. 9,136,600.

(51) Int. Cl.

| | |
|---|---|
| ***H01Q 7/08*** | (2006.01) |
| ***H01Q 7/06*** | (2006.01) |
| ***H01Q 1/22*** | (2006.01) |
| ***H01Q 1/38*** | (2006.01) |

(52) U.S. Cl.

CPC ..... *H01Q 7/06* (2013.01); *H01Q 1/2225* (2013.01); *H01Q 1/38* (2013.01); *H01Q 7/08* (2013.01)

(58) Field of Classification Search

CPC ..... H01Q 7/06; H01Q 1/2225; H01Q 1/08

See application file for complete search history.

(56) References Cited

U.S. PATENT DOCUMENTS

| | | | | |
|---|---|---|---|---|
| 5,638,080 | A | 6/1997 | Orthmann et al. | |
| 6,396,455 | B1 | 5/2002 | Ely et al. | |
| 7,126,482 | B2 | 10/2006 | Shoji et al. | |
| 7,280,076 | B2 | 10/2007 | Ninomiya et al. | |
| 7,405,697 | B2 * | 7/2008 | Ying | H01Q 1/243 343/700 MS |

(Continued)

FOREIGN PATENT DOCUMENTS

| | | |
|---|---|---|
| CN | 1475003 A | 2/2004 |
| CN | 1839515 A | 9/2006 |

(Continued)

OTHER PUBLICATIONS

JP Office Action; "Notification of Reasons for Rejection"; JP2010-180926; dated Jun. 28, 2011.

(Continued)

*Primary Examiner* — Trinh Dinh

(74) *Attorney, Agent, or Firm* — Studebaker & Brackett PC

(57) ABSTRACT

An antenna includes antenna coil having a magnetic-material core and a coil conductor. The antenna coil is arranged toward a side of a planar conductor, such as a circuit board. Of the coil conductor, a first conductor part close to a first main face of the magnetic-material core and a second conductor part close to a second main face of the magnetic-material core are provided such that the first conductor part is not over the second conductor part in view from a line in a direction normal to the first main face or the second main face of the magnetic-material core. In addition, a coil axis of the coil conductor is orthogonal to the side of the planar conductor.

11 Claims, 14 Drawing Sheets

(56) References Cited

U.S. PATENT DOCUMENTS

| | | | | |
|---|---|---|---|---|
| 7,825,860 | B2 * | 11/2010 | Ying | H01Q 1/243 343/700 MS |
| 9,136,600 | B2 * | 9/2015 | Yosui | H01Q 1/2225 343/787 |
| 9,160,060 | B2 * | 10/2015 | Yosui | G06K 7/10336 |
| 2003/0226892 | A1 * | 12/2003 | Arimura | G06K 7/10336 235/439 |
| 2005/0007296 | A1 * | 1/2005 | Endo et al. | 343/895 |
| 2006/0151619 | A1 | 7/2006 | Ninomiya et al. | |
| 2006/0187053 | A1 | 8/2006 | Koele | |
| 2007/0247387 | A1 | 10/2007 | Kubo et al. | |
| 2008/0062045 | A1 * | 3/2008 | Dinallo | H01Q 1/243 343/700 MS |
| 2009/0096694 | A1 * | 4/2009 | Ito et al. | 343/788 |
| 2010/0164823 | A1 | 7/2010 | Kubo et al. | |
| 2010/0309081 | A1 * | 12/2010 | Kobayashi et al. | 343/788 |
| 2012/0208606 | A1 * | 8/2012 | Kubo | G06K 19/07779 455/575.7 |

FOREIGN PATENT DOCUMENTS

| | | | | |
|---|---|---|---|---|
| CN | 1871743 | A | 11/2006 | |
| CN | 101128957 | A | 2/2008 | |
| GB | 2469209 | A | 10/2010 | |
| JP | 2002-325013 | A | 11/2002 | |
| JP | 2002-373319 | A | 12/2002 | |
| JP | 2004-048135 | A | 2/2004 | |
| JP | 2005-033461 | A | 2/2005 | |
| JP | 2005-134942 | A | 5/2005 | |
| JP | 2006-074534 | A | 3/2006 | |
| JP | 2006-310589 | A | 11/2006 | |
| JP | 2010-245776 | A | 10/2010 | |
| JP | 2010 252402 | * | 11/2010 | H01Q 7/06 |
| JP | 2010-252402 | A | 11/2010 | |
| WO | 2004/030148 | A1 | 4/2004 | |

OTHER PUBLICATIONS

JP Office Action; "Notification of Reasons for Rejection"; JP2011-056364; dated Jun. 28, 2011.

CN Office Action; CN201010154724.3; dated Aug. 29, 2012.

The Combined Search and Examination Report under Section 17 and 18(3) from United Kingdom Intellectual Property Office dated Jun. 25, 2010; Application No. GB1005634.9

The first Office Action issued by the State Intellectual Property Office of People's Republic of China dated Sep. 1, 2014, which corresponds to Chinese Patent Application No. 201310052252.4 and is related to U.S. Appl. No. 13/765,541; with English language translation.

* cited by examiner

ANTENNA

FIELD OF THE INVENTION

The present invention relates to an antenna used in, for example, a Radio Frequency Identification (RFID) system that communicates with an external device by using electromagnetic field signals.

BACKGROUND

An antenna mounted in a mobile electronic device used in an RFID system is disclosed in Japanese Unexamined Patent Application Publication No. 2002-325013 (Patent Document 1). FIG. 1 is a top view illustrating the structure of an antenna apparatus described in Patent Document 1.

An antenna coil 30 illustrated in FIG. 1 includes an air core coil 32 and a planar magnetic core member 33. The air core coil 32 is configured by spirally winding conductors 31 (31*a*, 31*b*, 31*e*, and 31*d*) in a plane on a film 32*a*. The magnetic core member 33 is inserted into the air core coil 32 so as to be substantially parallel to a plane of the air core coil 32. The air core coil 32 has an aperture 32*d* and the magnetic core member 33 is inserted into the aperture 32*d*. A first terminal 31*a* is connected to a connecting conductor 31*e* via a through hole 32*b*, and a second terminal 31*b* is connected to the connecting conductor 31*e* via a through hole 32*c*. And, the magnetic-material antenna is arranged on a conductive plate 34.

The rear face of the magnetic-material antenna in Patent Document 1 illustrated in FIG. 1 is a metal plate, and the magnetic flux flows laterally (from right to left in the state illustrate in FIG. 1). The flowing magnetic flux produces an electromotive force in the coil conductor to pass an electric current through the coil conductor.

However, the magnetic-material antenna in Patent Document 1 has a structure in which coupling with the magnetic flux that is parallel to the rear conductive plate 34 is achieved, as illustrated in FIG. 1. Accordingly, when the antenna is mounted in, for example, a mobile phone terminal, the mobile phone terminal cannot be used with being held over the surface of a reader-writer in parallel if the antenna is installed in parallel with a circuit board in the casing of the mobile phone terminal. In addition, when the antenna coil is placed near the center of the conductive plate 34, the communication is established only within a short range and the position where the maximum communication distance is achieved is greatly shifted from the center of the casing, thus degrading the usability.

SUMMARY

The invention is directed to an antenna including an antenna coil and a planar conductor. The antenna coil has a coil wound about a magnetic-material core having a first main face and a second main face. The antenna coil is arranged closely to the planar conductor. The first main face of the magnetic-material core opposes the planar conductor.

The antenna coil is arranged toward a side of the planar conductor with respect to the center of the planar conductor. Of the coil conductor, a first conductor part close to the first main face of the magnetic-material core is positioned so as not to be over a second conductor part close to the second main face of the magnetic-material core in view from the normal line direction of the first main face or the second main face of the magnetic-material core.

A coil axis of the coil conductor is orthogonal to the side of the planar conductor.

According to a more specific exemplary embodiment, the coil conductor may have a conductor pattern formed on a flexible substrate and may have a helical shape that is cut out along a cutout line, and the flexible substrate is wound around four faces of the magnetic-material core to join the coil conductor at the part corresponding to the cutout line.

According to another more specific exemplary embodiment, the coil conductor may be formed on a flexible substrate and have a spiral shape, and the flexible substrate may be wrapped over three faces of the magnetic-material core.

According to yet another more specific exemplary embodiment, the coil conductor may have a spiral shape, the flexible substrate has a through hole provided at a central part of the position where the coil conductor is formed, and the magnetic-material core is inserted into the through hole.

According to another more specific exemplary embodiment, a relationship $W \geq Y$ may be established, where W denotes the distance between a part of the coil conductor adjacent to a first face of the magnetic-material core and connecting the first conductor part to the second conductor part, and a part of the coil conductor adjacent to a second face of the magnetic-material core opposite the first face and connecting the first conductor part to the second conductor part, and Y denotes the length of the magnetic-material core, which is orthogonal to the side of the planar conductor.

According to another more specific exemplary embodiment, an end of the magnetic-material core, where magnetic flux comes in and out, may be made wider than the remaining part.

According to another more specific exemplary embodiment, a relationship $Y>X$ may be established, where X denotes the distance from the end of the antenna toward the side of the planar conductor to the side of the planar conductor and Y denotes the length of the antenna coil, which is orthogonal to the side of the planar conductor.

In yet another more specific exemplary embodiment, the planar conductor is a circuit board on which the antenna coil is installed.

In another more specific exemplary embodiment, the second conductor part may be provided in a position far from the center of the planar conductor, compared with the first conductor part.

Another more specific exemplary embodiment, the second conductor part is arranged in a position near to the center of the planar conductor, compared with the first conductor part.

According to another more specific exemplary embodiment, the magnetic-material core may be a plate magnetic-material core.

According to another more specific exemplary embodiment, the planar conductor may be a substantially rectangular plate.

DETAILED DESCRIPTION

FIGS. 2A to 2D include diagrams illustrating the structure of an antenna according to a first exemplary embodiment.

Figure 1:
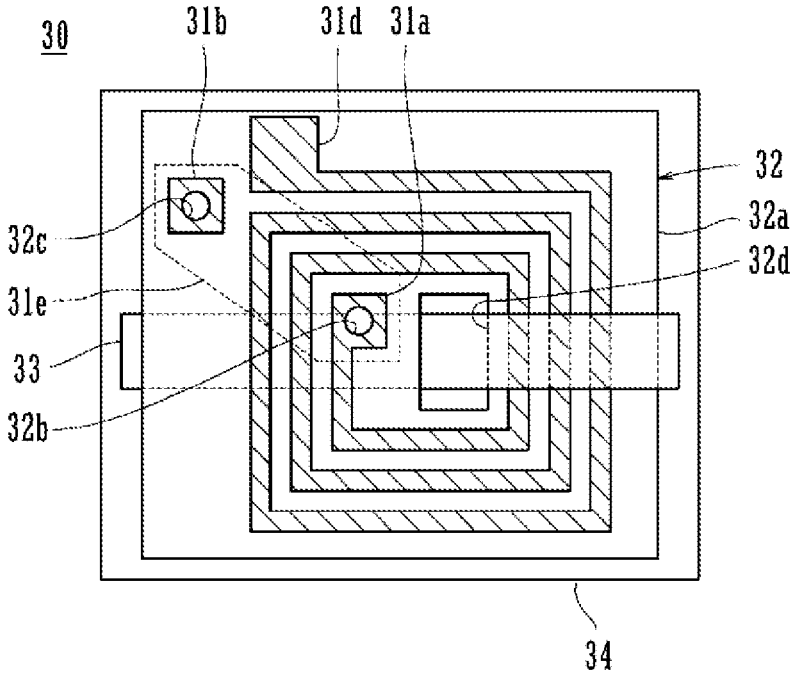
FIG. 1 Prior Art
FIG. 1 is a top view illustrating the structure of an antenna apparatus described in Patent Document 1.
Figure 2A:
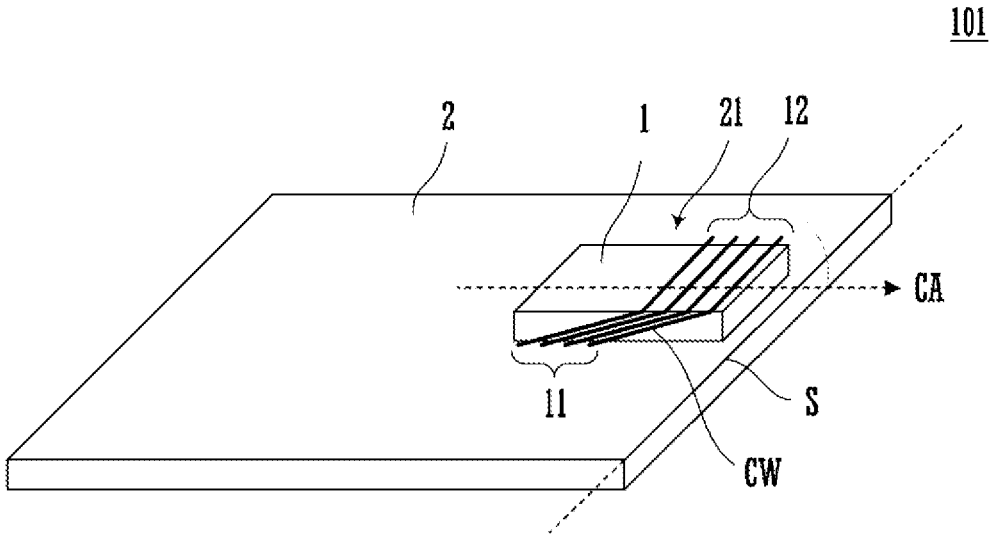
FIG. 2A is a perspective view diagram illustrating the structure of a magnetic-material antenna and an antenna apparatus according to a first exemplary embodiment.
Figure 2B:
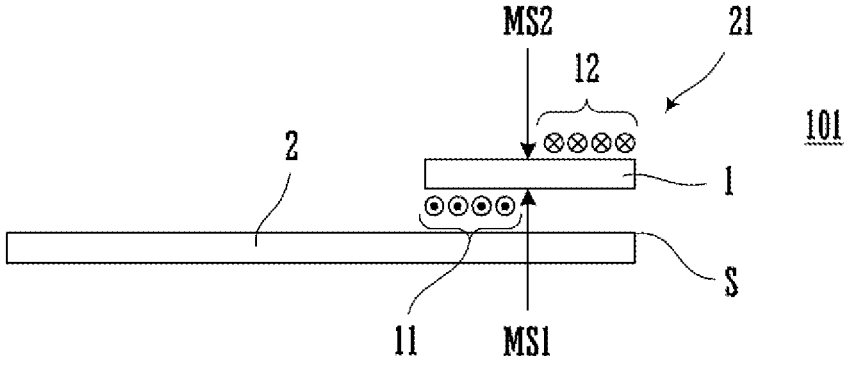
FIG. 2B is a front view of the antenna shown in FIG. 1.
Figure 2C:
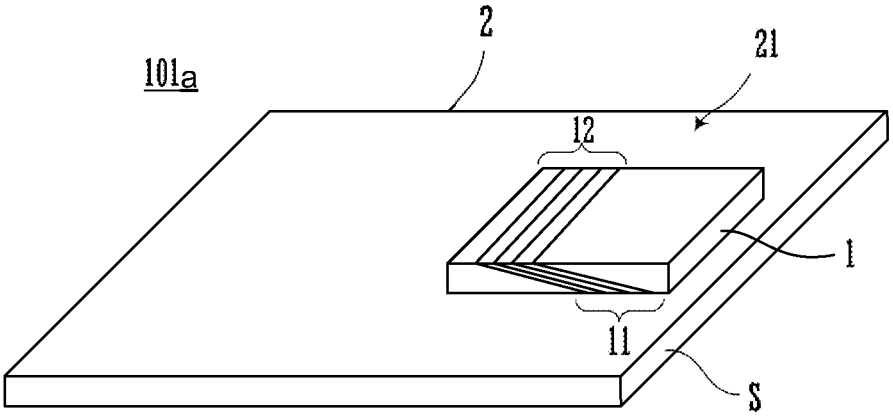
FIG. 2C is a perspective view diagram of modified version of the exemplary antenna shown in FIGS. 2A and 2B.
Figure 2D:
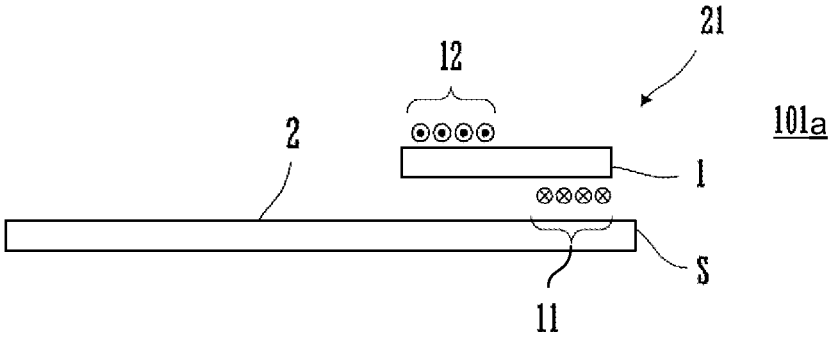
FIG. 2D is a front view of the antenna shown in FIG. 2C.

FIG. 2A is a perspective view of an antenna 101 including an antenna coil 21 and a planar conductor 2, such as a circuit board, on which the antenna coil 21 is installed and which is a rectangular plate. FIG. 2B is a front view of the antenna 101. FIG. 2C is a perspective view of another antenna 101*a* according to the first exemplary embodiment. FIG. 2D is a front view of the antenna 101*a* shown in FIG. 2C.

As shown in FIGS. 2A to 2D, an antenna according to the first exemplary embodiment includes a magnetic-material core 1, which is a ferrite core having a rectangular planar shape, and the bottom face in FIG. 2 corresponds to a first main face MS1 and the top face in FIG. 2 corresponds to a second main face MS2. A coil conductor CW is wound around the magnetic-material core 1, as illustrated in FIGS. 2A to 2D. A part denoted by reference numeral 11 in the figures indicates a first conductor part of the coil conductor CW, which is close to the first main face MS1 of the magnetic-material core 1. A part denoted by reference numeral 12 in the figures indicates a second conductor part that is close to the second main face MS2 of the magnetic-material core 1. The magnetic-material core 1 and the coil conductor CW compose the antenna coil 21.

The antenna coil 21 is arranged toward a certain side S (the right side in the orientation shown in FIGS. 2A to 2D) with respect to the center of the planar conductor 2. Additionally, the first conductor part 11 and the second conductor part 12 are arranged such that the second conductor part 12 is not over the first conductor part 11 in view from (in a perspective view from) the normal line direction of the first main face MS1 or the second main face MS2 of the magnetic-material core 1. In addition, in antenna 101 the second conductor part 12 is arranged in a position far from the center of the planar conductor 2, compared with the first conductor part 11. Furthermore, a coil axis CA of the coil conductor CW is orthogonal to the side S of the planar conductor 2. As shown in FIGS. 2C and 2D, an antenna 101*a* can have the second conductor part 12 arranged in a position nearer to the center of the planar conductor 2, compared with the first conductor part 11.

Figure 3A:
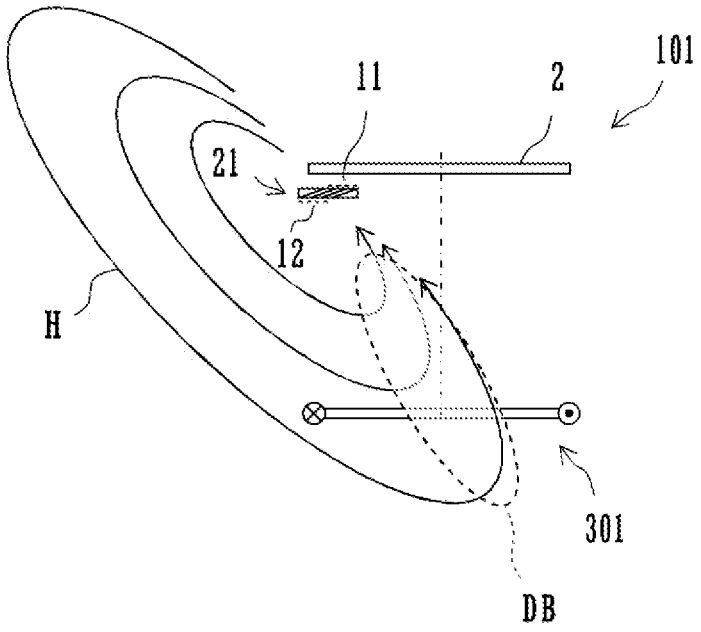
FIG. 3A illustrates a distribution and directivity of the magnetic flux around an antenna according the first exemplary embodiment.
Figure 3B:
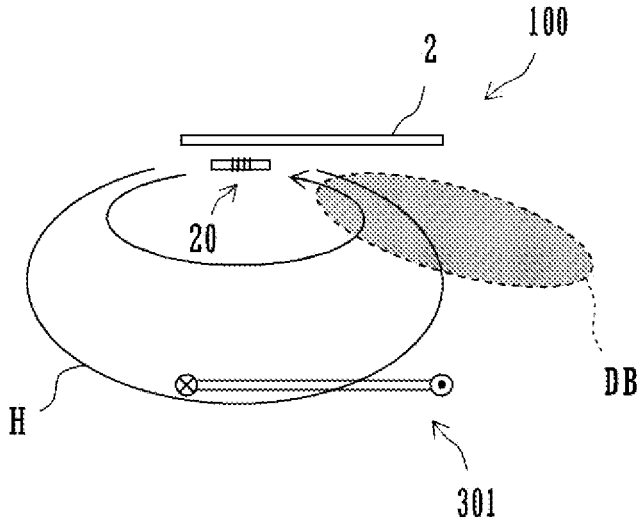
FIG. 3B illustrates distribution and directivity of the magnetic flux around an antenna having a conventional structure, which is illustrated in contrast to the antenna according to the first exemplary embodiment.

FIG. 3A illustrates the distribution and directivity of the magnetic flux H around the antenna 101. FIG. 3B illustrates the distribution and directivity of the magnetic flux around an antenna having a conventional structure, which is illustrated in contrast to the antenna according to the first embodiment. In the antenna 101, the antenna coil 21 is arranged in a position close to a reader-writer-side antenna 301, compared with the planar conductor 2. This state corresponds to a state in which an electronic device including the antenna 101 is held over a reading part of the reader-writer.

In FIGS. 2A and 2B, since the second conductor part 12 of the coil conductor CW is positioned toward the outside with respect to the center of the planar conductor 2, compared with the first conductor part 11, the long axis of the loop of a magnetic flux H passing through the magnetic-material core of the antenna coil 21 is inclined from the surface of the planar conductor 2, as illustrated in the FIG. 3A. In other words, the component in the normal line direction (the Z-axis direction) of the planar conductor 2 is intensified. Accordingly, a directivity beam DB of the antenna 101 is directed to the center of the reader-writer-side antenna 301. In the antenna 101*a* shown in FIGS. 2C and 2D, since the second conductor part 12 is arranged in a position near to the center of the planar conductor 2 compared with the first conductor part 11, the communication performance can be improved in a broad angular range without depending on a positional relationship with a target, to communicate in a longitudinal direction of the planar conductor 2 for example turning the edge of the planar conductor 2 toward the target.

On the other hand, as illustrated in FIG. 3B, in an antenna coil 20 in related art having a positional relationship in which the second conductor part close to the second main face of the magnetic-material core is over the first conductor part close to the first main face of the magnetic-material core, the long axis of the loop of the magnetic flux H passing through the magnetic-material core is parallel to the planar conductor 2 and, therefore, the directivity beam DB of the antenna is directed to a direction along the surface of the planar conductor 2. Consequently, the maximum communicatable distance is reduced if an antenna 100 is made close to the reader-writer-side antenna 301 and in parallel, and the maximum communicatable distance is increased if the antenna 100 is made close to the reader-writer-side antenna 301 at a tilt, instead.

In contrast, according to the first exemplary embodiment, it is possible to increase the maximum communicatable distance and the maximum communicatable distance is achieved in a state in which the center of the antenna 101 or 101*a* coincides with the center of the reader-writer-side antenna 301.

Next, an example of communication between an integrated circuit (IC) card for RFID and an electronic device, such as a mobile phone terminal, including the antenna 101 or 101*a* will now be described.

Figure 4A:
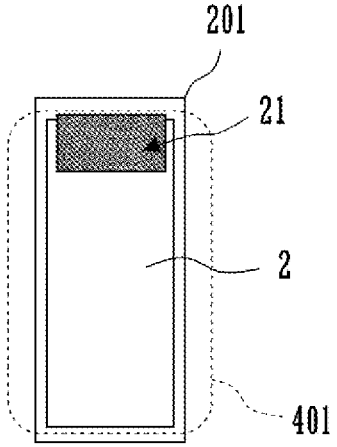
FIG. 4A illustrates a state in which an electronic device such as a mobile phone terminal, including an antenna according to the first exemplary embodiment is made close to an IC card and in which both of the electronic device and the IC card are longitudinally directed.
Figure 4B:
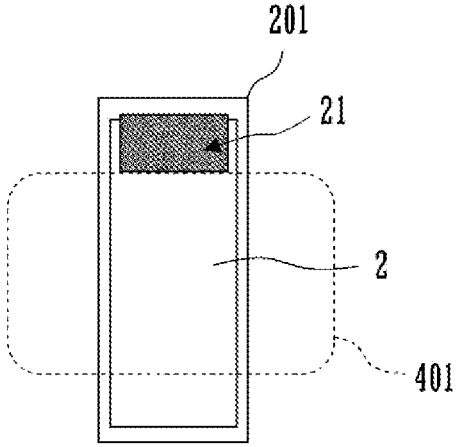
FIG. 4B illustrates a state in which the electronic device such as a mobile phone terminal, including an antenna according to the first exemplary embodiment is arranged so as to be orthogonal to the IC card.

FIGS. 4A and 4B are diagrams illustrating the arrangement relationship between an IC card for RFID and an electronic device, such as a mobile phone terminal, including the antenna 101 or 101*a*. An antenna configured by arranging the antenna coil 21 along an end of the planar conductor 2 is included in a casing 201 of the electronic device. FIG. 4A illustrates a state in which the electronic device is made close to an IC card 401 and in which both of the electronic device and the IC card 401 are longitudinally directed. FIG. 4B illustrates a state in which the electronic device is arranged so as to be orthogonal to the IC card 401. The IC card 401 includes an antenna coil that is formed along the outer edge of the IC card 401 and that has a plural number of turns, and the antenna coil in the IC card 401 is magnetically coupled to the antenna coil 21.

In the above state in which the antenna coil 21 is arranged along an end of the planar conductor 2, if an IC card having approximately the same size as that of the planar conductor 2 is made close to the electronic device, the distance between the coil conductor of the antenna coil in the IC card 401 and the coil conductor of the antenna coil 21 of the antenna according to the present embodiment is decreased. As a result, strong coupling is achieved between the antennas.

As described above, the antenna is adapted not only to the communication with, for example, a reader-writer that is apart from the antenna by around 100 mm but also to the communication in a state in which the antenna is substantially in contact with an IC card.

Specifically, in the antenna of the present invention, the coil conductor is wound so as to achieve excellent communication performance even if the antenna coil is arranged along an end of the planar conductor. Compared with the antenna using the antenna coil having a conventional structure in which the coil conductor is simply wound around the magnetic-material core, the antenna of the present invention achieves a greater magnetic field strength contributing to the communication and a higher communication performance (the performance concerning the communicatable distance and the error rate of the communication data).

Figure 5:
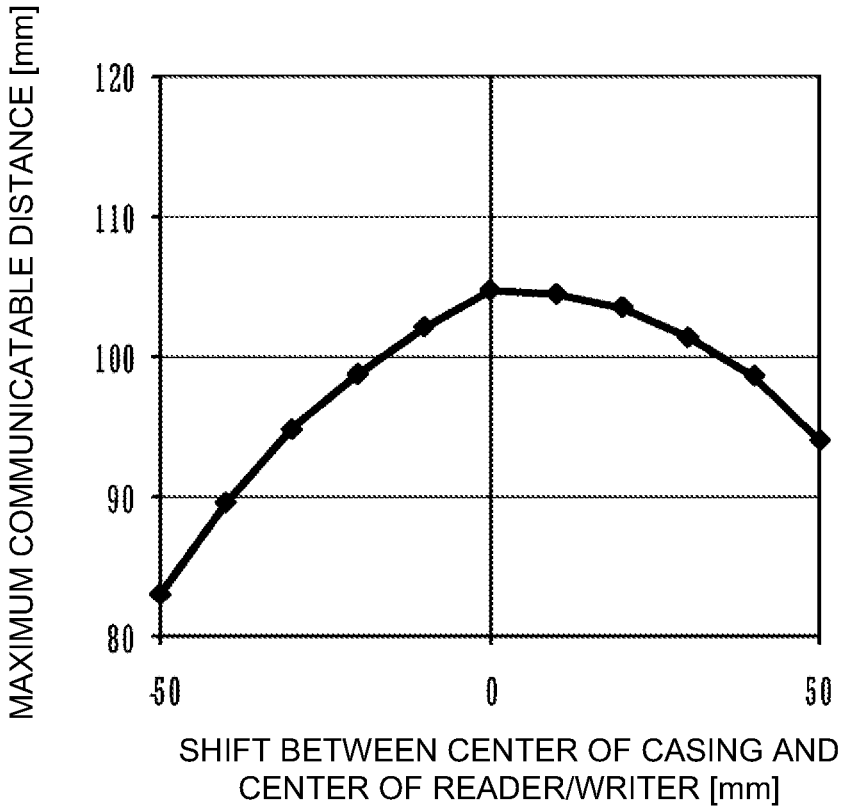
FIG. 5 illustrates the relationship between the maximum communicatable distance and a shift between the center of the casing of an electronic device including an antenna according to the first exemplary embodiment and the center of a reader-writer-side antenna.

FIG. 5 illustrates the relationship between the maximum communicatable distance and a shift between the center of the casing of an electronic device including the antenna 101 according to the first embodiment and the center of a reader-writer-side antenna. Referring to FIG. 5, the position where the center of the reader-writer-side antenna coincides with the center of the casing of the electronic device is set as the origin, and the amount of shift between the center of the reader-writer-side antenna and the center of the casing of the electronic device is represented as the horizontal axis.

The size of the loop of the reader-writer-side antenna is about 65 mm×100 mm, the size of the casing of the electronic device is about 45 mm×90 mm, and the size of the antenna coil 21 is about 20 mm×15 mm.

As illustrated in FIG. 5, the maximum communicatable distance is peaked when the center of the reader-writer-side antenna coincides with the center of the casing of the electronic device.

Figure 6A:
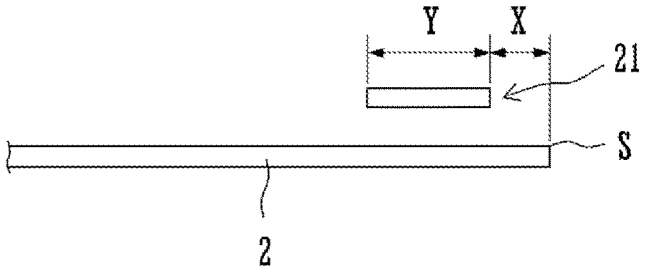
FIGS. 6A and 6B are diagrams illustrating the positional relationship between a planar conductor and an antenna coil.
Figure 6B:
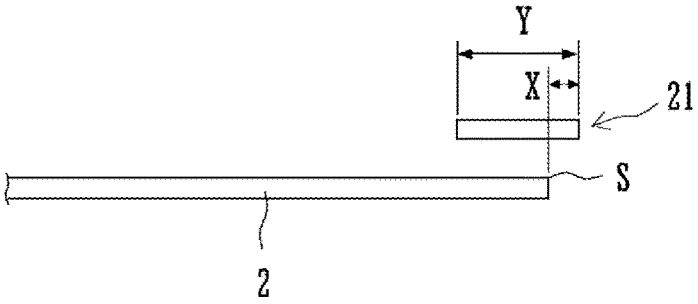

FIGS. 6A and 6B include diagrams illustrating the positional relationship between the planar conductor 2 and the antenna coil 21. A relationship Y>X is established, where X denotes the distance from an end of the antenna coil 21 toward the side S of the planar conductor 2 to the side S and Y denotes the length of the antenna coil 21, which is orthogonal to the side S of the antenna coil 21.

The relationship between X and Y will now be described with reference to FIGS. 7A and 7B.

Figure 7A:
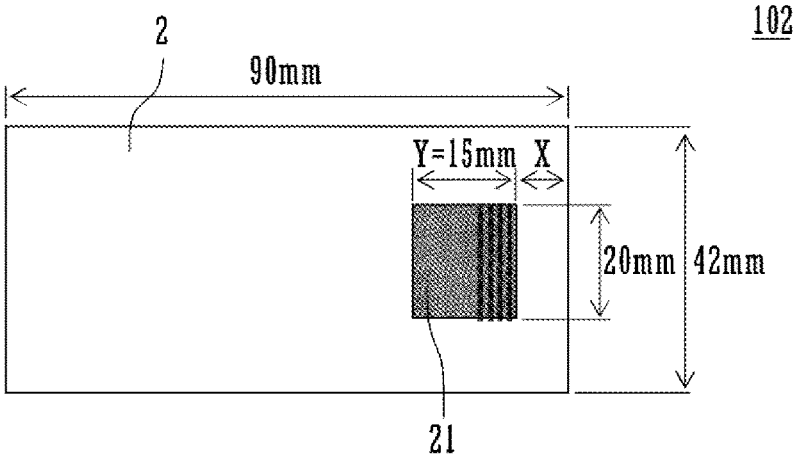
FIG. 7A is a plan view illustrating the positional relationship between a planar conductor and the antenna coil.

FIG. 7A is a plan view of an example illustrating the positional relationship between the planar conductor 2 and the antenna coil 21. In this example, the planar conductor 2 has a size of 42 mm×90 mm and the antenna coil 21 has a size of 20 mm×15 mm. FIG. 7B illustrates the relationship between the distance X and the coupling coefficient in the antenna coil 21 according to the first exemplary embodiment and an antenna coil having a conventional structure. In the antenna coil having a conventional structure, which is a comparative example, the first conductor part and the second conductor part have a positional relationship in which the second conductor part close to the second main face of the magnetic-material core is over the first conductor part close to the first main face of the magnetic-material core. In addition, the antenna of the reader-writer has a size of 100 mm×100 mm and the antenna including the antenna coil 21 opposes the antenna of the reader writer at a distance of 30 mm.

Figure 7B:
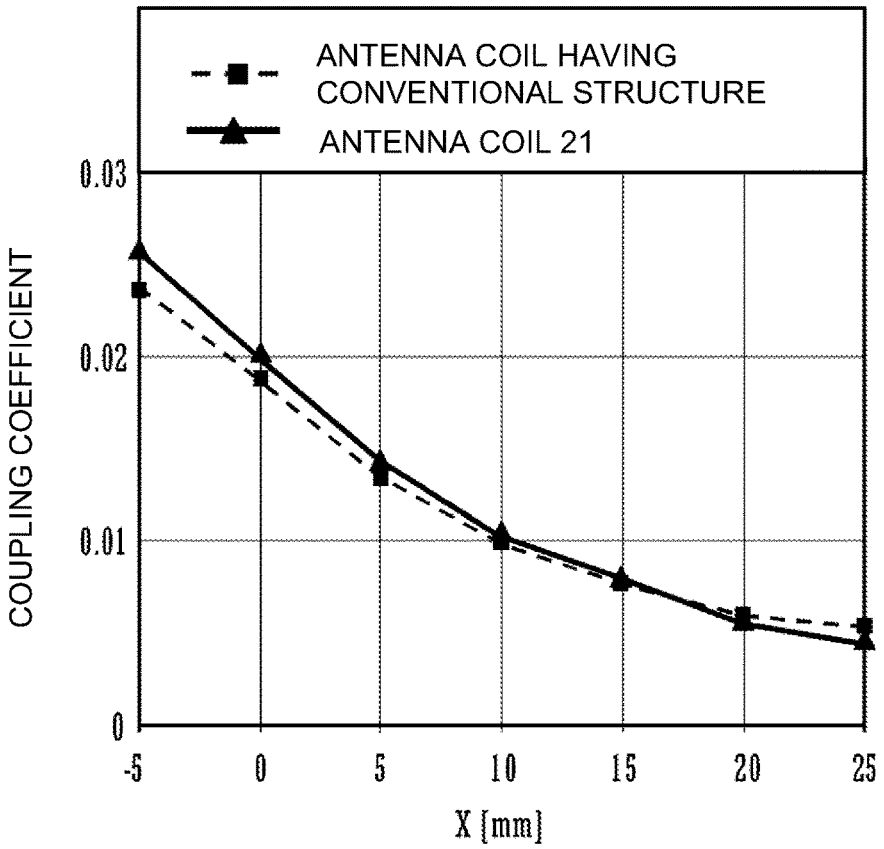
FIG. 7B is a graph illustrating the relationship between a distance X and the coupling coefficient in an antenna coil according to the first exemplary embodiment and an antenna coil having a conventional structure.

As illustrated in FIG. 7B, the coupling coefficient of the antenna coil 21 is greater than that of the antenna coil having a conventional structure when X<15 mm. Since Y=15 here, it is found that a greater coupling coefficient is achieved, compared with the antenna coil having a conventional structure, when Y>X.

As also illustrated in FIG. 7B, the dimension X may have a negative value. Specifically, as in an example consistent with FIG. 6B, an end of the antenna coil 21 may be positioned outside the side S of the planar conductor 2.

The above relationship allows the orientation of the directivity beam DB illustrated in FIG. 3A to be raised to achieve a longer maximum communicatable distance and an antenna that has the position where the communicatable distance is maximized at substantially the center of the casing.

Figure 8A:
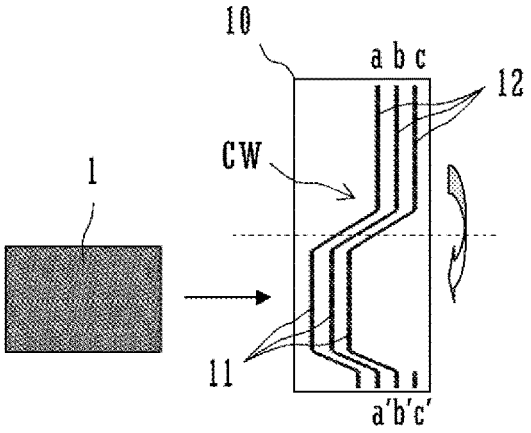
FIG. 8A illustrates a state before assembling an antenna coil according to a second exemplary embodiment.
Figure 8B:
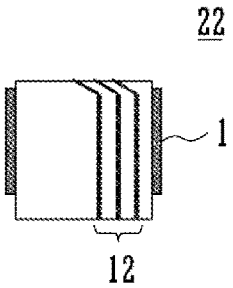
FIG. 8B is a plan view of the antenna coil 22.

FIG. 8A illustrates a state before an antenna coil 22 according to a second exemplary embodiment is assembled. FIG. 8B is a plan view of the assembled antenna coil 22. As illustrated in FIG. 8A, a coil conductor CW is formed on a flexible substrate 10. The coil conductor CW has a conductor pattern in which a coil having a helical shape is cut out along a certain cutout line. The flexible substrate 10 is wound around four faces of a magnetic-material core 1 and ends of the coil conductor CW connect to the corresponding ends of the coil conductor CW at the parts corresponding to the cutout line. In this example, an end a connects to an end a', an end b connects to an end b', and an end c connects to an end c' with solder or the like. This composes the antenna coil 22 illustrated in FIG. 8B.

In the orientation illustrated in FIG. 8B, a second conductor part 12 is close to the top face (the second main face) of the magnetic-material core 1 and a first conductor part 11 is close to the bottom face (the first main face) of the magnetic-material core 1.

Figure 9A:
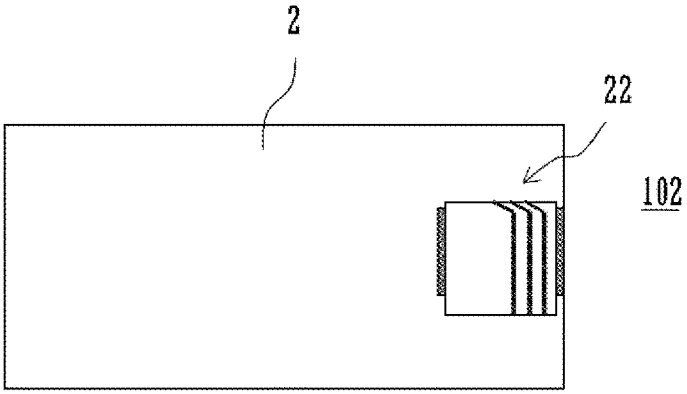
FIG. 9A is a bottom view of an antenna including the antenna coil shown in FIGS. 8A and 8B according to the exemplary second embodiment.
Figure 9B:
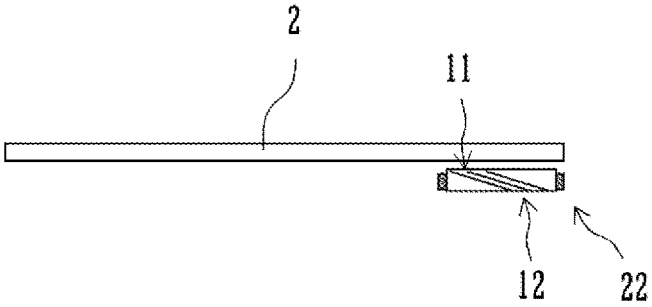
FIG. 9B is a front view of the antenna shown in FIG. 9A.

FIG. 9A is a bottom view of an antenna 102 including the antenna coil 22 according to an exemplary embodiment. FIG. 9B is a front view of the antenna 102. The antenna coil 22 is installed along a central part of one side of the planar conductor 2, which is a circuit board.

Figure 9C:
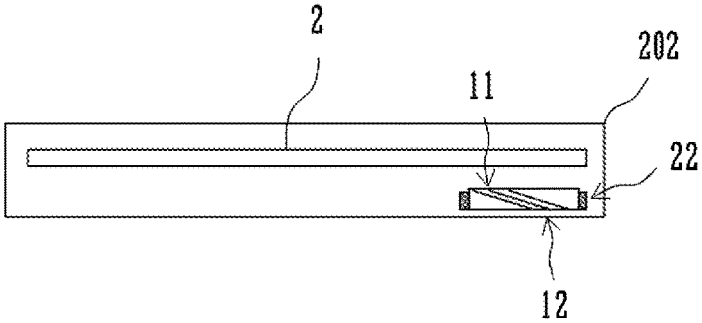
FIG. 9C illustrates an example in which the antenna coil is fixed in a casing including the planar conductor, which is a circuit board.

FIG. 9C illustrates an example in which the antenna coil 22 is fixed in a casing 202 including the planar conductor 2, which is a circuit board. Also in this case, the second conductor part 12 is arranged in a position far from the center of the planar conductor 2, compared with the first conductor part 11.

Operational advantages similar to those described in the first exemplary embodiment are offered in the above manner.

Figure 10A:
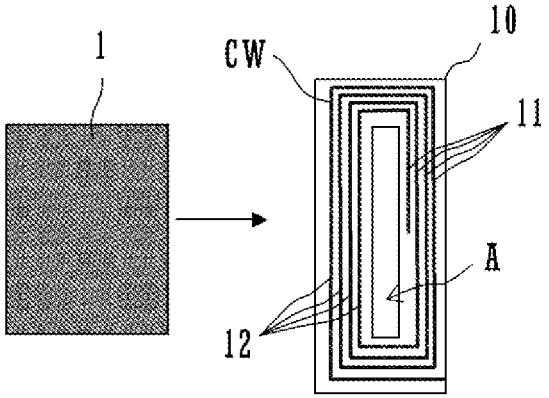
FIG. 10A is a plan view before assembling an antenna coil according to a third exemplary embodiment.
Figure 10B:
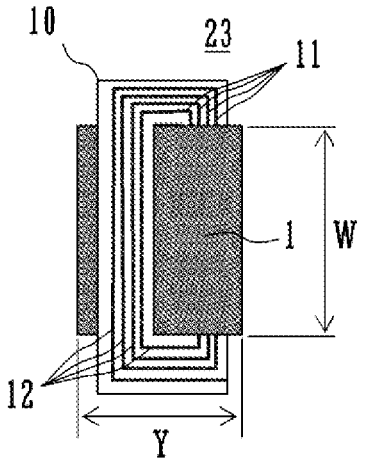
FIG. 10B is a plan view of the antenna coil shown in FIG. 10A.

FIG. 10A is a plan view before assembly of an antenna coil 23 according to a third exemplary embodiment. FIG. 10B is a plan view of the antenna coil 23. A coil conductor CW having a spiral shape is formed on a flexible substrate 10, and a through hole A is provided at a central part of the position where the spiral coil conductor is formed. A magnetic-material core 1 is inserted into the through hole A of the flexible substrate 10 to compose the antenna coil 23 illustrated in FIG. 10B.

Figure 11A:
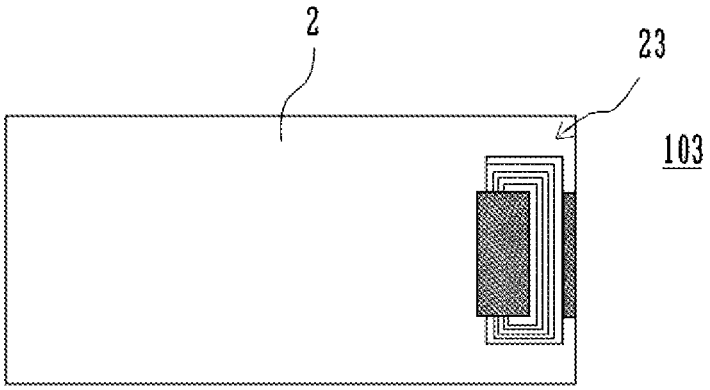
FIG. 11A is a bottom view of an antenna including the antenna coil according to the third exemplary embodiment.
Figure 11B:
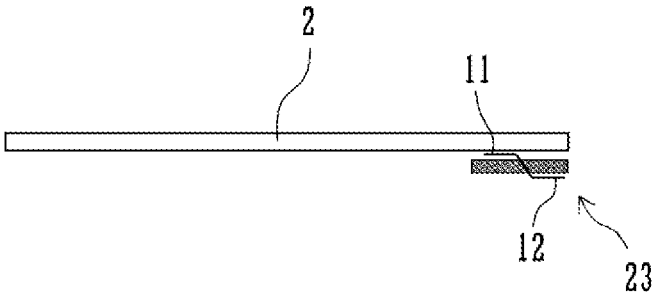
FIG. 11B is a front view of the antenna shown in FIG. 11A.

FIG. 11A is a bottom view of an antenna 103 including the antenna coil 23 according to the second exemplary embodiment. FIG. 11B is a front view of the antenna 103. The antenna coil 23 is installed along a central part of one side of the planar conductor 2, which is a circuit board.

Figure 11C:
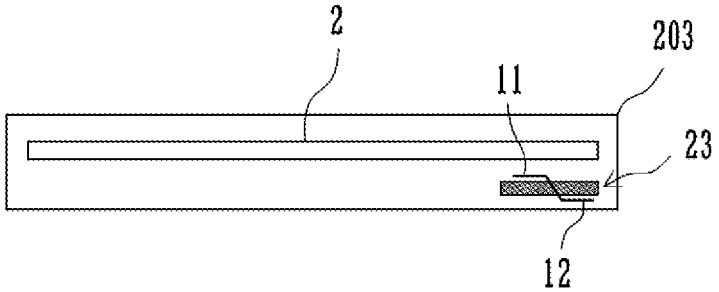
FIG. 11C illustrates an example of the antenna shown in FIGS. 11A and 11B in which an antenna coil is fixed in a casing including the planar conductor, which is a circuit board.

FIG. 11C illustrates an example in which the antenna coil 23 is fixed in a casing 203 including the planar conductor 2, which is a circuit board, unlike the examples in FIG. 11A and FIG. 11B. Also in this case, the second conductor part 12 is arranged in a position far from the center of the planar conductor 2, compared with the first conductor part 11.

Operational advantages similar to those described in the first exemplary embodiment are offered in the above manner.

The relationship between W and Y will now be described with reference to FIG. 12, where W denotes the distance between the narrowest parts or shortest segments of the coil conductor at opposite faces of the magnetic-material core, which connect the first conductor part 11 to the second conductor part 12, and Y denotes the length of the magnetic-material core, which is orthogonal to the side of the planar conductor, as illustrated in FIG. 10B.

Figure 12:
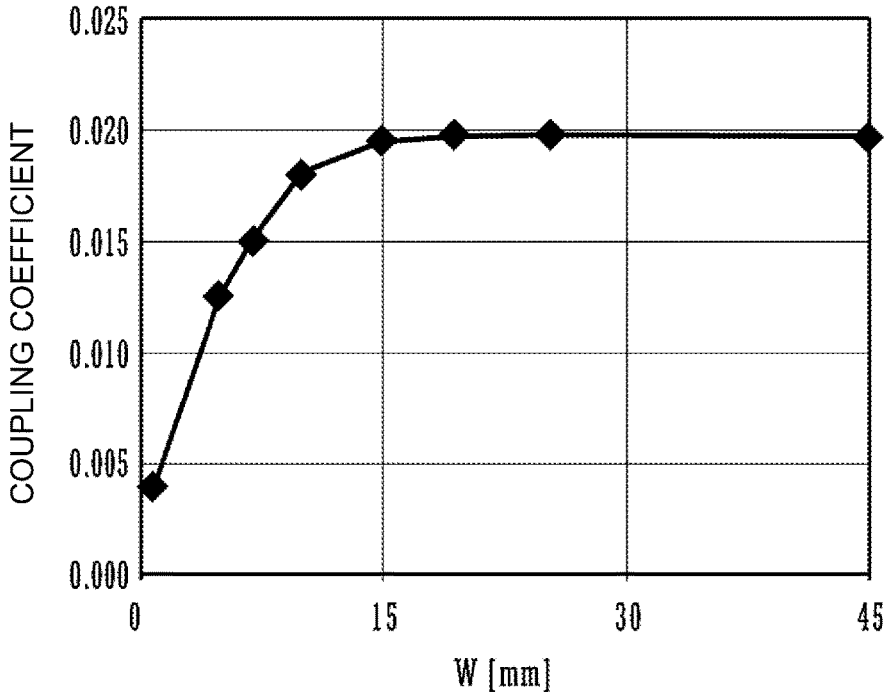
FIG. 12 illustrates the relationship between W and the coupling coefficient when the product of W and Y is set to a constant value and W is varied, where W denotes the distance between the narrowest parts of a coil conductor, which connect a first conductor part 11 to a second conductor part 12, and Y denotes the length of a magnetic-material core, which is orthogonal to a side of the planar conductor.

FIG. 12 illustrates the relationship between W and the coupling coefficient when the product of W and Y is set to a constant value, 15×15=225 $mm^2$ and W is varied. In this example, the antenna of the reader-writer has a size of 100 mm×100 mm and the antenna including the antenna coil 23 opposes the antenna of the reader writer at a distance of 30 mm.

When W<Y (when W<15 mm), the coupling coefficient is decreased with the decreasing W, thus degrading the communication performance. Accordingly, it is possible to ensure an excellent communication performance by establishing a relationship W≥Y.

Figure 13A:
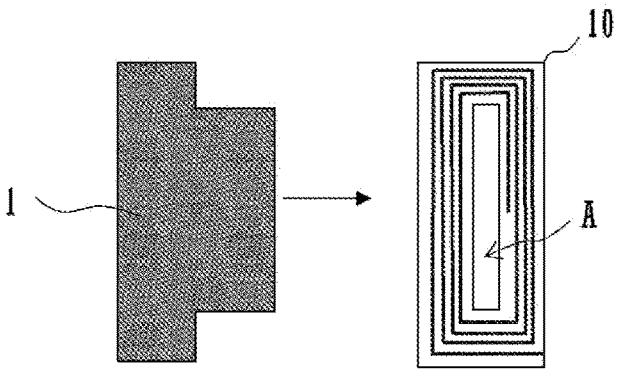
FIG. 13A is a plan view of an antenna coil according to a fourth exemplary embodiment before assembling the antenna coil.
Figure 13B:
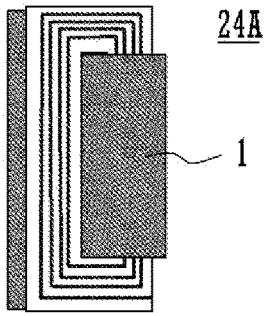
FIG. 13B is a plan view of the antenna coil shown in FIG. 13A assembled.
Figure 14A:
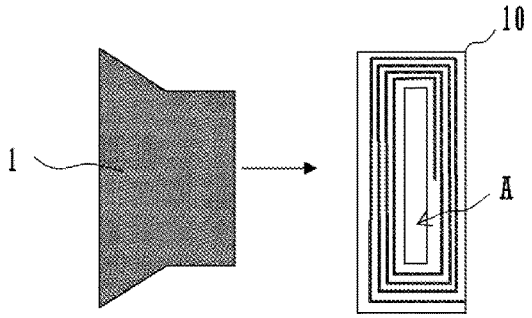
FIG. 14A is a plan view before another antenna coil according to the fourth embodiment is assembled.
Figure 14B:
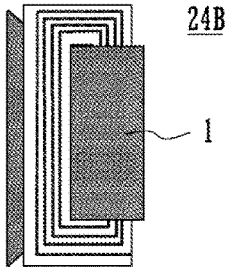
FIG. 14B is a plan view of the antenna coil shown in FIG. 14A assembled.
Figure 15A:
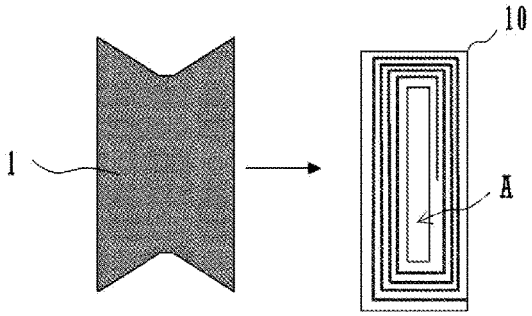
FIG. 15A is a plan view before another antenna coil according to the fourth embodiment is assembled.
Figure 15B:
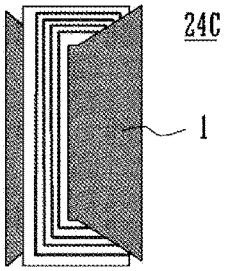
FIG. 15B is a plan view of the antenna coil shown in FIG. 15A assembled.

FIGS. 13A to 15B illustrate the structures of antenna coils 24A, 24B, and 24C according to a fourth exemplary embodiment. FIG. 13A is a plan view before the antenna coil 24A is assembled. FIG. 13B is a plan view of the assembled antenna coil 24A. FIG. 14A is a plan view before the antenna coil 24B is assembled. FIG. 14B is a plan view of the antenna coil 24B assembled. Similarly, FIG. 15A is a plan view before the antenna coil 24C is assembled. FIG. 15B is a plan view of the assembled antenna coil 24C.

Each of the antenna coils 24A to 24C differs from the antenna coil 23 illustrated in FIG. 10 in that the end where the magnetic flux around the magnetic-material core 1 comes in and out is made wider than the remaining part. In the antenna coil 24A illustrated in FIGS. 13A and 13B, one end of the magnetic-material core 1 is wholly made wider (thicker). In the antenna coil 24B in FIGS. 14A and 14B, one end of the magnetic-material core 1 is expanded in a trapezoid shape. In the example of the antenna coil 24C in FIGS. 15A and 15B, the magnetic-material core 1 has a shape in which both ends are made wider than the central part.

The use of the magnetic-material cores 1 having the above shapes causes the magnetic flux passing through the magnetic-material core 1 to be expanded to increase the magnetic field coupling with a target antenna. As a result, the communication performance is improved, for example, the maximum communicatable distance is increased.

Figure 16A:
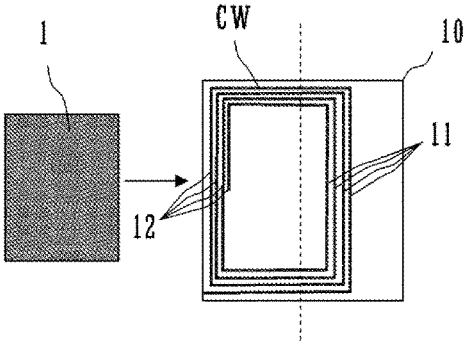
FIG. 16A is a plan view before an antenna coil according to a fifth exemplary embodiment is assembled.

FIG. 16A is a plan view before assembly of an antenna coil 25 according to a fifth exemplary embodiment. FIG.

16B is a top view of the antenna coil 25. FIG. 16C is a bottom view of the antenna coil 25. A flexible substrate 10 is folded along a line indicated by a broken line in the figure and a magnetic-material core 1 is caught in the folded flexible substrate 10 (the flexible substrate 10 is wrapped over three faces of the magnetic-material core 1). A coil conductor CW having a spiral shape around a position shifted from the fold line is formed on the flexible substrate 10. Of the coil conductor CW, a side far from the fold line is used as a second conductor part 12 and a side near the fold line is used as a first conductor part 11.

Figure 17A:
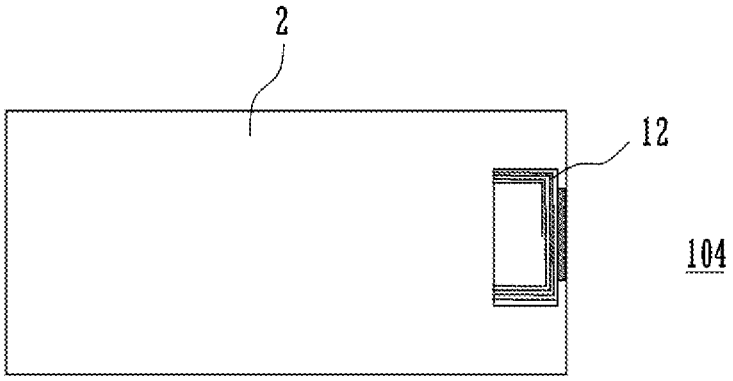
FIG. 17A is a bottom view of an antenna including an antenna coil according to the fifth exemplary embodiment.
Figure 17B:
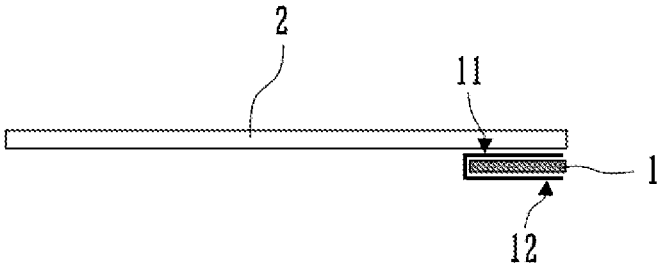
FIG. 17B is a front view of the antenna shown in FIG. 17A.

FIG. 17A is a bottom view of an antenna 104 including the antenna coil 25. FIG. 17B is a front view of the antenna 104. The antenna coil 25 is installed along a central part of one side of the planar conductor 2, which is a circuit board.

Figure 17C:
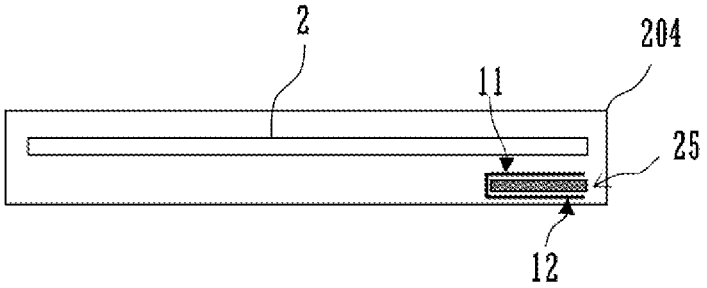
FIG. 17C illustrates an example in which the antenna coil shown in FIGS. 17A and 17 is fixed in a casing including the planar conductor, which is a circuit board.

FIG. 17C illustrates an example in which the antenna coil 25 is fixed in a casing 204 including the planar conductor 2, which is a circuit board, unlike the examples in FIG. 17A and FIG. 17B. Also in this case, the second conductor part 12 is arranged in a position far from the center of the planar conductor 2, compared with the first conductor part 11.

Operational advantages similar to those described in the first exemplary embodiment are offered in the above manner.

Figure 18A:
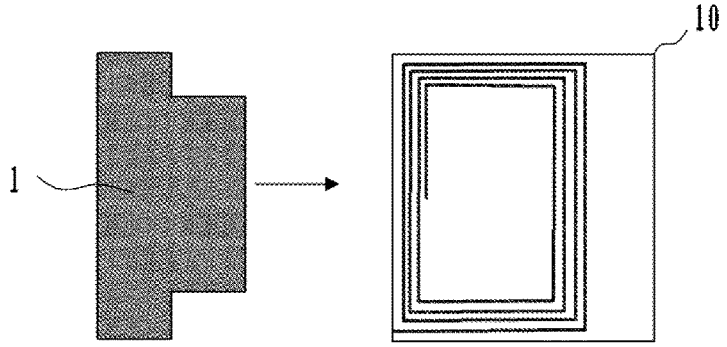
FIG. 18A is a plan view before assembling an antenna coil according to a sixth exemplary embodiment.
Figure 18B:
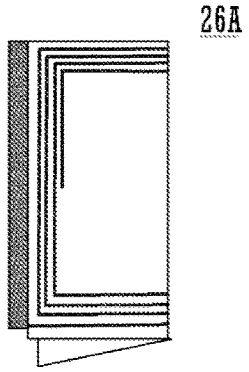
FIG. 18B is a plan view of the antenna coil shown in FIG. 18A assembled.
Figure 19A:
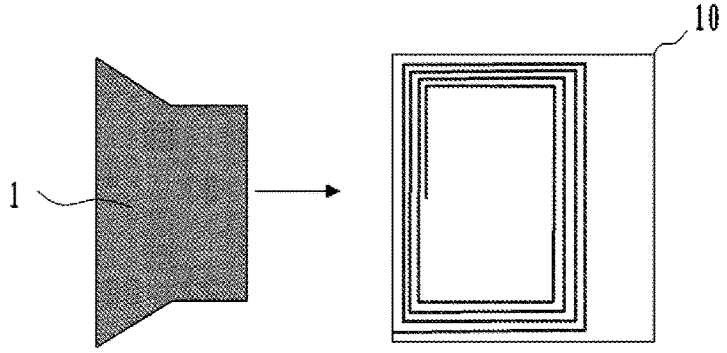
FIG. 19A is a plan view before assembling another antenna coil according to the sixth exemplary embodiment.
Figure 19B:
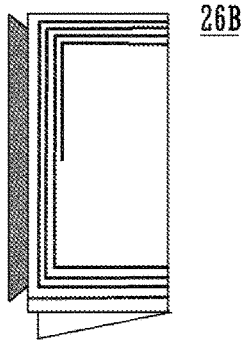
FIG. 19B is a plan view of the antenna coil shown in FIG. 19A assembled.
Figure 20A:
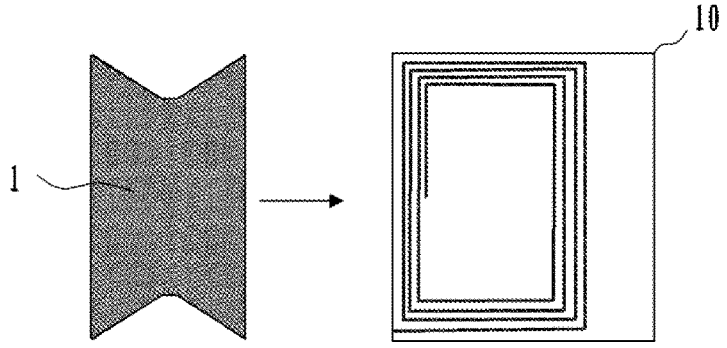
FIG. 20A is a plan view before assembling another antenna coil according to the sixth embodiment.
Figure 20B:
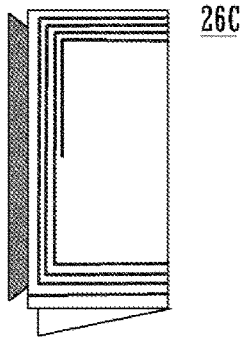
FIG. 20B is a plan view of the antenna coil shown in FIG. 20A assembled.

FIGS. 18A to 20B illustrate the structures of antenna coils 26A, 26B, and 26C according to a sixth exemplary embodiment. FIG. 18A is a plan view before the antenna coil 26A is assembled. FIG. 18B is a plan view of the assembled antenna coil 26A. FIG. 19A is a plan view before the antenna coil 26B is assembled. FIG. 19B is a plan view of the assembled antenna coil 26B. Similarly, FIG. 20A is a plan view before the antenna coil 26C is assembled. FIG. 20B is a plan view of the assembled antenna coil 26C.

Figure 16B:
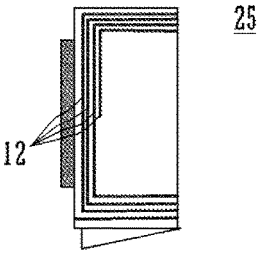
FIG. 16B is a top view of the antenna coil shown in FIG. 16A assembled.
Figure 16C:
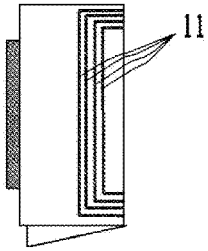
FIG. 16C is a bottom view of the assembled antenna coil shown in FIG. 16B.

Each of the antenna coils 26A to 26C differs from the antenna coil 25 illustrated in FIGS. 16A and 16B in that the end where the magnetic flux around the magnetic-material core 1 comes in and out is made wider than the remaining part. In the antenna coil 26A illustrated in FIGS. 18A and 18B, one end of the magnetic-material core 1 is wholly made wider (thicker). In the antenna coil 26B in FIGS. 19A and 19B, one end of the magnetic-material core 1 is expanded in a trapezoid shape. In the example of the antenna coil 26C in FIGS. 20A and 20B, the magnetic-material core 1 has a shape in which both ends are made wider than the central part.

The use of the magnetic-material cores 1 having the above shapes causes the magnetic flux passing through the magnetic-material core 1 to be expanded to increase the magnetic field coupling with a target antenna. As a result, the communication performance is improved, for example, the maximum communicatable distance is increased.

Accordingly, embodiments consistent with the claimed invention can provide an antenna that has a longer maximum communicatable distance and an antenna having a position where the communicatable distance is maximized at substantially the center of a casing of an electronic device including the antenna.

Although a limited number of exemplary embodiments of the invention have been described above, it is to be understood that variations and modifications will be apparent to those skilled in the art without departing from the scope and spirit of the invention. The scope of the invention, therefore, is to be determined solely by the following claims and their equivalents.

What is claimed is:

1. An antenna comprising an antenna coil and a planar conductor, the antenna coil including a magnetic-material core having a first main face and a second main face and a coil conductor wound around the magnetic-material core, the antenna coil being positioned adjacent to a planar surface of the planar conductor and configured to transmit magnetic flux to a reader part of a reader-writer and couple magnetically therewith, wherein the first main face of the magnetic-material core opposes the planar conductor, and wherein, in a plan view of the planar surface, the entire antenna coil is positioned towards one side of the center of the planar surface of the planar conductor between a first end and an opposite second end thereof and arranged toward a side of the planar conductor such that the magnetic flux passing through the magnetic-material core is inclined from the planar surface of the planar conductor.

2. The antenna according to claim 1, wherein the coil conductor has a conductor pattern formed on a flexible substrate that is bendable so as to be wound around the first and second main faces of the magnetic-material core.

3. The antenna according to claim 1, wherein an end of the magnetic-material core where magnetic flux comes in and out is made wider than the remaining part.

4. The antenna according to claim 1, wherein a relationship $Y>X$ is established, where X denotes the distance from the end of the antenna coil toward the side of the planar conductor to the side of the planar conductor and Y denotes the length of the magnetic-material core, which is orthogonal to the side of the planar conductor.

5. The antenna according to claim 1, wherein the planar conductor is part of a circuit board on which the antenna coil is installed.

6. The antenna according to claim 1, wherein, of the coil conductor, a first conductor part close to the first main face of the magnetic-material core is positioned so as not to be over a second conductor part close to the second main face of the magnetic-material core in view from line in a direction normal to the first main face or the second main face of the magnetic-material core.

7. The antenna according to claim 2, wherein a coil axis of the coil conductor is orthogonal to the side of the planar conductor.

8. The antenna according to claim 6, wherein the second conductor part is provided in a position farther from the center of the planar conductor than the first conductor part.

9. The antenna according to claim 6, wherein the second conductor part is provided in a position nearer to the center of the planar conductor than the first conductor part.

10. The antenna according to claim 1, wherein the magnetic-material core is a plate magnetic-material core.

11. The antenna according to claim 1, wherein the planar conductor is a substantially rectangular plate.

* * * * *